US006232926B1

(12) United States Patent
Nguyen et al.

(10) Patent No.: US 6,232,926 B1
(45) Date of Patent: May 15, 2001

(54) DUAL COUPLED VEHICLE GLASS MOUNT ANTENNA SYSTEM

(75) Inventors: Anh Nguyen, Boynton Beach; Argyrios A. Chatzipetros, Lake Worth; Hien Duc Ma, Delray Beach, all of FL (US)

(73) Assignee: XM Satellite Radio Inc., Washington, DC (US)

( * ) Notice: Subject to any disclaimer, the term of this patent is extended or adjusted under 35 U.S.C. 154(b) by 0 days.

(21) Appl. No.: 09/438,814

(22) Filed: Nov. 10, 1999

(51) Int. Cl.[7] ..... H01Q 1/32
(52) U.S. Cl. ..... 343/713; 343/704
(58) Field of Search ..... 343/711, 712, 343/713, 704, 850; 455/86, 90; H01Q 1/32, 1/38

(56) References Cited

U.S. PATENT DOCUMENTS

| | | | | |
|---|---|---|---|---|
| 4,835,541 | * | 5/1989 | Johnson et al. | 343/713 |
| 5,289,197 | * | 2/1994 | Lindenmeier et al. | 343/713 |
| 5,477,232 | * | 12/1995 | Yamamoto | 343/713 |
| 5,805,113 | * | 9/1998 | Ogino et al. | 343/713 |
| 5,977,919 | * | 11/1999 | Kudo et al. | 343/713 |
| 6,069,588 | * | 5/2000 | O'Neill | 343/713 |

OTHER PUBLICATIONS

U.S. application No. 08/654321, Crosby, filed Jul. 1999.

* cited by examiner

*Primary Examiner*—Tho G. Phan

(74) *Attorney, Agent, or Firm*—William J. Benman

(57) ABSTRACT

A dual coupled vehicle glass mount antenna system and method. The inventive system is adapted for operation through any suitable partition, such as an automobile windshield, and comprises an antenna mounted on a first side of the partition for receiving a signal and a first circuit connected to the antenna. The antenna and the first circuit are mounted on a first side of the partition. In accordance with the present teachings, an arrangement is provided for supplying power to the first circuit. The output of the first circuit is coupled through the partition to a second circuit mounted on a second side thereof by a first coupling arrangement. In the illustrative embodiment, the antenna is a radio frequency antenna, the partition is a vehicle windshield, the first circuit is an amplifier, and the arrangement for supplying power is a second coupling arrangement. In the illustrative embodiment, the first and second coupling arrangements are coils and power is supplied to the second coupling arrangement from a direct current source by a cable. In alternative embodiments, power is supplied to the first circuit by a battery or solar cell arrangement. In the illustrative embodiment, the second circuit includes an impedance matching circuit and a transmitter or receiver depending upon the application. The location of the amplifier on the antenna side of the windshield reduces the noise figure of the system and provides improved gained relative to the conventional design.

27 Claims, 1 Drawing Sheet

DUAL COUPLED VEHICLE GLASS MOUNT ANTENNA SYSTEM

BACKGROUND OF THE INVENTION

1. Field of the Invention

The present invention relates to antenna systems. More specifically, the present invention relates to antenna systems mounted on glass windshields of vehicles.

2. Description of the Related Art

Antennas are required for virtually every wireless communication application including radio, cellular, and global positioning system (GPS) applications. Many such applications involve the use of transmitters and/or receivers mounted in vehicles. For these applications, glass mounted antennas are often used. Typically, the antenna is electrically connected to a coupling mechanism which is secured to an outside surface of the windshield of the vehicle. On the opposite side of the windshield, a second coupling device couples radio frequency energy from the antenna to the transmitter or receiver via a cable.

Unfortunately, a coupling loss is typically experienced with conventional glass mount antenna arrangements. At 800 MHz, the coupling loss may be as much as 3 decibels. At higher frequencies, the coupling loss increases substantially. Consequently, for certain high frequency applications, such as satellite radio (at 2.4 GHz), the coupling loss is expected to be unacceptably high (2–4 dB).

As these losses would make reception difficult, a need exists in the art for a system or technique for reducing the losses associated with glass mounted vehicle antennas for high frequency wireless communication applications, particularly satellite radio applications.

SUMMARY OF THE INVENTION

The need in the art is addressed by the dual coupled vehicle glass mount antenna system and method of the present invention. The inventive system is adapted for operation through any suitable partition, such as an automobile windshield, and comprises an antenna mounted on a first side of the partition for receiving a signal and a first circuit connected to the antenna. The antenna and the first circuit are mounted on a first side of the partition. In accordance with the present teachings, an arrangement is provided for supplying power to the first circuit. The output of the first circuit is coupled through the partition to a second circuit mounted on a second side thereof by a first coupling arrangement.

In the illustrative embodiment, the antenna is a radio frequency antenna, the partition is a vehicle windshield, the first circuit is an amplifier, and the arrangement for supplying power includes a second coupling arrangement. In the illustrative embodiment, the first and second coupling arrangements are coils and power is supplied to the second coupling arrangement from a direct current source by a cable. In alternative embodiments, power is supplied to the first circuit by a battery or solar cell arrangement. In the illustrative embodiment, the second circuit includes an impedance matching circuit and a transmitter or receiver depending upon the application.

The location of the amplifier on the antenna side of the windshield reduces the noise figure of the system and provides improved gained.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Several methods of transferring radio frequency (RF) energy through a glass plate are known in the art. These methods are useful in that, they allow antennas to be mounted on vehicles without the need for drilling.

Figure 1:
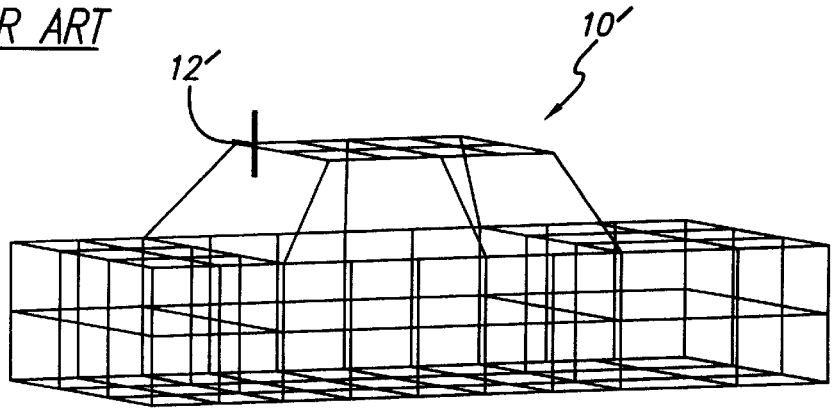
FIG. 1 PRIOR ART
FIG. 1 is a diagram which illustrates the mounting of an antenna on a vehicle in accordance with conventional teachings.

FIG. 1 is a diagram which illustrates the mounting of an antenna 12' on a vehicle 10' in accordance with conventional teachings. In accordance with conventional teachings, RF energy is transferred though a glass plate, partition or windshield by various means, such as capacitive coupling, slot coupling, and aperture coupling.

Figure 2:
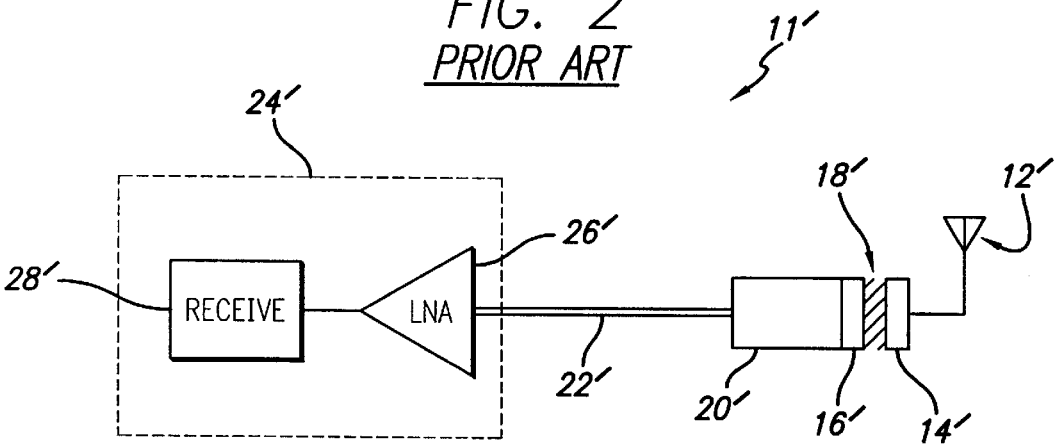
FIG. 2 PRIOR ART
FIG. 2 is a block diagram of a conventional arrangement for coupling radio frequency energy received from an antenna through a windshield in accordance with conventional teachings.

FIG. 2 is a block diagram of a conventional arrangement for coupling radio frequency energy received from an antenna through a windshield in accordance with conventional teachings. The arrangement 11' includes coupling elements 14' and 16' which transfer electromagnetic energy received from an antenna 12' through a windshield 18'. The coupling elements 14' and 16' may be implemented with capacitive plates, a slot, or an aperture. An impedance matching circuit 20' is typically electrically connected to the second coupling element 16' for optimum power transfer. The matching circuit 20' may include passive components or traces on a board. The matching circuit 20' is often implemented with one or two capacitors or a micro-strip line which acts as a transformer depending upon the frequency of operation or impedance desired. In typical application, the impedance matching circuit is designed to provide a 50 ohm impedance.

The output of the impedance matching circuit 20' is provided to a low noise amplifier (LNA) 26' by a cable or transmission line 22'. The output of the low noise amplifier 26' is input to a receiver 28'.

An inherent drawback of conventional coupling arrangements is that the noise in the system is typically increased by losses in the RF coupling arrangement, the matching circuit, and the cable. The losses may be on the order of 2–3 decibels. As mentioned above in the Description of the Related Art, these losses limit the utility of conventional RF coupling arrangements for certain applications, such as satellite communication applications.

The present invention addresses this problem by providing the an arrangement in which radio frequency energy is transferred across a partition such as a windshield without significant degradation of the system noise figure. As discussed in detail below, the inventive system includes an antenna mounted on a first side of the windshield along with a first circuit such as an amplifier. In accordance with the present teachings, an arrangement is provided for supplying power to the amplifier thereby allowing for its advantageous location relative to the antenna. In the illustrative embodiment, the arrangement for supplying power to the amplifier is a first coupling arrangement mounted on either side of the windshield. A second coupling arrangement facilitates the transfer of signals between the amplifier and a processing circuit located on the other side of the windshield relative to the amplifier. As discussed more fully below, the location of the amplifier on the antenna side of the windshield reduces the noise figure of the system and provides improved gained.

Figure 3:
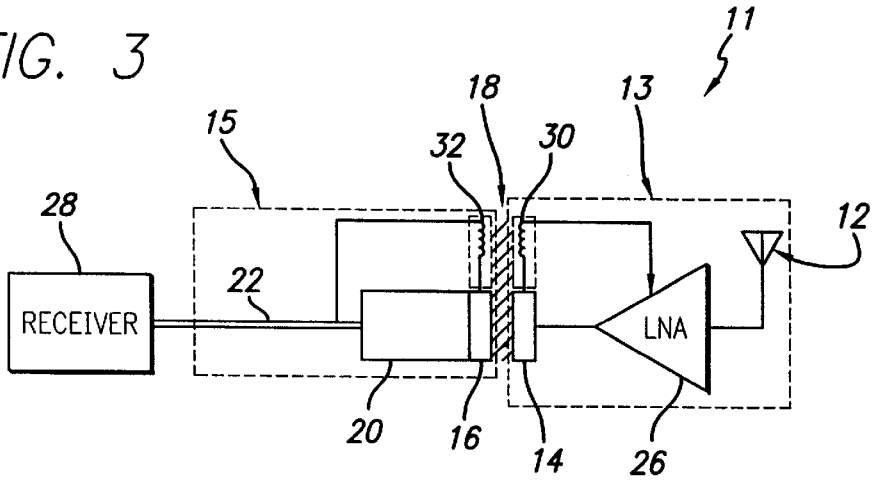
FIG. 3 is a block diagram of an illustrative implementation of an RF coupling arrangement constructed in accordance with the teachings of the present invention.

FIG. 3 is a block diagram of an illustrative implementation of an RF coupling arrangement constructed in accordance with the teachings of the present invention. The system normal 11 employs a pair of modules 13 and 15. The first module 13 is fixed on an exterior surface of the windshield 18 and the second module 15 is fixed on the interior surface of the windshield 18 using a typical conventional attachment arrangement such as a bonding glue or an arrangement of nuts and bolts. The first module 13 includes an antenna 12, a low-noise amplifier (LNA) 26, and the first RF coupling unit 14 as per the conventional arrangement of FIG. 2. In addition, in accordance with the present teachings, the first module 13 includes a first low-frequency coupling coil 30 which supplies power to the low noise amplifier 26.

The interior module 15 includes a second RF coupling unit 16, a matching circuit 20, and an RF cable or transmission line 22.

In the illustrative embodiment, in accordance with present teachings, the interior module 15 further includes a second low-frequency coupling coil 32. The low-frequency coupling coils 30 and 32 act as a power transformer with the windshield 18 providing a glass core therefor. The coils 30 and 32 are commercially available and presently may be purchased from TDK and other manufacturers. Those skilled in the art will understand that the turns ratio of the coils will be determined at the time of manufacture based on a specification of an input and an output voltage for a given application.

In the illustrative embodiment, the first coil 30 has tens of turns and the second coil 32 has 200 to 300 turns. (Those skilled in the art will appreciate that the present invention is not limited to the turns ratio of the coils 30 and 32.) The receiver 28 provides an AC voltage of 48 volts through the second and first coils 32 and 30, respectively. In the exterior module 13, the voltage is rectified to a DC voltage of 12 volts and then regulated to the voltage required by the low noise amplifier 26, i.e., 3 to 5 volts DC.

In addition, the coil diameter is a matter of design choice. For example, in the illustrative embodiment, the coils were chosen to have a diameter on the order of ½ inch.

In the illustrative embodiment, direct current (DC) power is transferred to the exterior module 13 through the low-frequency coils 30 and 32, while RF energy is transferred through coupling units 14 and 16. As per the conventional arrangement of FIG. 2, the RF coupling units 14 and 16 may be implemented as capacitive plates, slots, with an aperture or by any other suitable method. (RF coupling arrangements are known in the art, see for example U.S. Pat. No. 5,565,877 entitled Ultra-High Frequency Slot Coupled Low Cost Antenna System, the teachings of which are incorporated herein by reference.)

Those skilled in the art will appreciate that the relocation of the low noise amplifier 26 from the interior side of the windshield 18 to the exterior side of the windshield 18, directly beneath the antenna 12, facilitates a substantial reduction in the noise figure of the system.

Hence, those skilled in the art will appreciate that utilizing the present teachings, and with proper choice of LNA (i.e., keeping the noise figure of the LNA as small as possible, e.g., on the order of 0.5 to 1 decibel), losses due to the matching circuit, cable loss, and RF coupling should not have a significant impact on system performance and the noise figure should remain low.

Those skilled in the art will appreciate that the teachings of the present invention may be utilized in connection with other arrangements for providing power. For example, the amplifier 26 may be powered by a battery or solar cell without departing from the scope the present teachings.

In addition, the present invention is not limited to use of a low noise amplifier 26. Other electrical, electronic an electro-optical circuits and/or components may be used on either side of the windshield without departing from the scope the present teachings as well.

Further, the invention is not limited to the coupling of power through a windshield. Those skilled in the art will appreciate that the present teachings may be utilized to couple power through other partitions as measured the required by a given application. In which case, the optimum coupling technology (conductive, capacitive, optical, etc.) and the coupling power will have to be determined by the designer on a case-by-case basis.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A system adapted for operation through a partition comprising:

first means mounted on a first side of said partition for receiving a signal;

second means mounted on said first side of said partition and electrically connected to said first means for processing said received signal, said second means including a low noise amplifier;

third means mounted on a second side of said partition for providing power to said second means on said first side of said partition;

fourth means for coupling the output of said second means through said partition, said fourth means being connected directly to said amplifier; and fifth means for processing the output of said fourth means.

2. The invention of claim 1 wherein said first means is a radio frequency antenna.

3. The invention of claim 1 wherein said partition is a windshield.

4. The invention of claim 3 wherein said third means includes means for coupling a power signal through said windshield.

5. The invention of claim 4 wherein said power signal is a direct current signal.

6. The invention of claim 1 wherein said third means for providing power to said second means includes a battery.

7. The invention of claim 1 wherein said third means for providing power to said second means includes a solar cell.

8. The invention of claim 1 wherein said fourth means for coupling the output of said second means through said partition includes first and second coupling units.

9. The invention of claim 8 wherein said first and second coupling units are radio frequency coupling units.

10. The invention of claim 9 wherein each of said coupling units is a coil.

11. The invention of claim 10 wherein each of said coupling units is mounted on an opposite side of said partition.

12. The invention of claim 1 wherein said fifth means for processing the output of said fourth means includes an impedance matching circuit.

13. The invention of claim 12 wherein said fifth means further includes a receiver.

14. The invention of claim 13 wherein said receiver is connected to said impedance matching circuit by a cable.

15. The invention of claim 14 wherein said third means for providing power to said second means includes sixth means for coupling a power signal through said partition.

16. The invention of claim 15 wherein said sixth means includes third and fourth coupling units.

17. The invention of claim 16 wherein each of said coupling units is a coil.

18. The invention of claim 17 wherein each of said coupling units is mounted on an opposite side of said partition.

19. The invention of claim 15 wherein said cable is connected to said sixth means at one end of said cable and to a source of power on the other end thereof.

20. The invention of claim 19 wherein said power signal is a direct current signal.

21. An antenna system for mobile satellite communications, said antenna system adapted for operation through a vehicle windshield and comprising:

an antenna for receiving a radio frequency signal;

an amplifier adapted to be mounted on a first side of said windshield and electrically connected to said antenna for amplifying said received signal;

a first coupling arrangement for coupling power through said windshield to said amplifier, said first coupling arrangement including a first coil mounted on a second side of said windshield and a second coil mounted on said first side of said windshield, said second coil being inductively coupled to said first coil through said windshield and electrically connected to said amplifier;

a second coupling arrangement for coupling the output of said amplifier through said windshield, said second coupling arrangement being a capacitive coupling arrangement connected directly to said amplifier on said first side of said windshield; and a circuit for processing the output of the second coupling arrangement, said circuit being connected to said second coupling arrangement on said second side of said windshield.

22. The invention of claim 21 wherein said amplifier is a low noise amplifier.

23. The invention of claim 21 wherein said circuit for processing the output of said second coupling arrangement includes an impedance matching circuit.

24. The invention of claim 23 wherein said circuit further includes a receiver.

25. The invention of claim 24 wherein said receiver is connected to said impedance matching circuit by a cable.

26. The invention of claim 25 wherein said cable is connected to said first coupling arrangement at one end of said cable and to a source of power on the other end thereof.

27. The invention of claim 26 wherein said power signal is a direct current signal.

* * * * *